United States Patent [19]

Schwab et al.

[11] 4,253,320

[45] Mar. 3, 1981

[54] MAGNETIC LOCK

[75] Inventors: Dittmar Schwab, Rodgau; Hermann Bartels, Mühlheim; Walter Graf, Obertshausen, all of Fed. Rep. of Germany

[73] Assignee: YMOS-Metallwerke Wolf & Becker GmbH & Co., Opertshausen, Fed. Rep. of Germany

[21] Appl. No.: 59,737

[22] Filed: Jul. 23, 1979

[30] Foreign Application Priority Data

Jul. 29, 1978 [DE] Fed. Rep. of Germany ..... 2833453

[51] Int. Cl.[3] ..... E05B 47/00

[52] U.S. Cl. ..... 70/276; 70/356; 70/365

[58] Field of Search ..... 70/276, 365, 366, 364 R, 70/364 A, 419, 421

[56] References Cited

U.S. PATENT DOCUMENTS 3,935,720 2/1976 Böving ..... 70/276

FOREIGN PATENT DOCUMENTS 2346529 10/1977 France ..... 70/276

*Primary Examiner*—Robert L. Wolfe

*Attorney, Agent, or Firm*—W. G. Fasse; D. F. Gould

[57] ABSTRACT

The present magnetic lock is operated by a key including control magnets. For this purpose a locking bar is radially shiftable in a locking cylinder in a housing. Magnetic rotors release or lock the locking bar which is spring biased toward the magnetic rotors. A spring biased control member is shiftable into a locking channel of the locking bar. The control member is equipped with entraining elements which engage the locking bar.

3 Claims, 6 Drawing Figures

MAGNETIC LOCK

BACKGROUND OF THE INVENTION

The invention relates to a magnetic lock for a key comprising control magnets. The lock has a bushing or lock housing and a locking cylinder which is rotatable in the lock housing. The lock further includes a radially displacable locking bar as well as magnetic rotors which lock or release the locking bar. Magnetic locks of the mentioned type are known. Normally, the magnetic rotors, which are rotatably supported in the locking cylinder, are provided with depressions or recesses and the magnetic rotors are aligned in such a manner with the aid of the fitting key that the recesses are located in register with bosses or projections of the locking bar, so that the bosses or projections may enter into the magnetic rotors, which operate as locking means, for unlocking the magnetic lock. To this end the locking portion of the locking bar projects out of a locking channel in the locking housing or bushing, so that the locking cylinder and an entraining member arranged in the locking cylinder are freely rotatable.

When a non-fitting key is used, the magnetic rotors position themselves in such a manner, that the projections on the locking bar cannot enter into the recesses of the magnetic rotors. The locking portion of the locking bar thus remains in the locking channel and the locking cylinder cannot rotate.

The radially inwardly directed displacement of the locking bar takes place in the prior art magnetic locks by means of control cams which limit the locking channel. As a result, the locking bar presses with its projections on the magnetic rotors with a relatively large pressure force when the locking cylinder is being rotated by force with the aid of a non-fitting key or when prematurely rotating a fitting key. Thus, damage to the magnetic rotors is not prevented.

OBJECTS OF THE INVENTION

It is the object of the invention to improve a magnetic lock of the type mentioned above in such a way that the locking bar possibly does not apply any load at all or at least a very small load to the magnetic rotors when an attempt is being made to open the lock with a non-fitting key.

SUMMARY OF THE INVENTION

To achieve this objective, the invention provides that a control member, which is spring supported in the locking cylinder, is shiftable into the locking channel of the locking bar, said control member comprising entraining elements engaging the locking bar, and that the locking bar is spring biased in the direction of the magnetic rotors.

As a result of these features, the locking bar can load the magnetic rotors only with that force which is applied by the springs urging the locking bar towards the magnetic rotors. The locking bar is not any more shifted radially inwardly by means of control surfaces when rotating the locking cylinder, as is the case in known magnetic locks, rather the locking bar is shifted solely with the aid of the spring effective on the locking bar. The force of these springs is predetermined and absolutely independent of any possible use of force by means of a non-fitting key.

The additionally provided control member makes sure that a locking bar moves into the locking position after the key is withdrawn. To this end, the entraining elements of the control member pull the locking bar radially inwardly.

Further features of the invention may be taken from the specification and the claims in conjunction with the drawing.

BRIEF FIGURE DESCRIPTION

In the following text the invention will be described in more detail with reference to an example embodiment, which is shown in the drawing.

Figure 1:
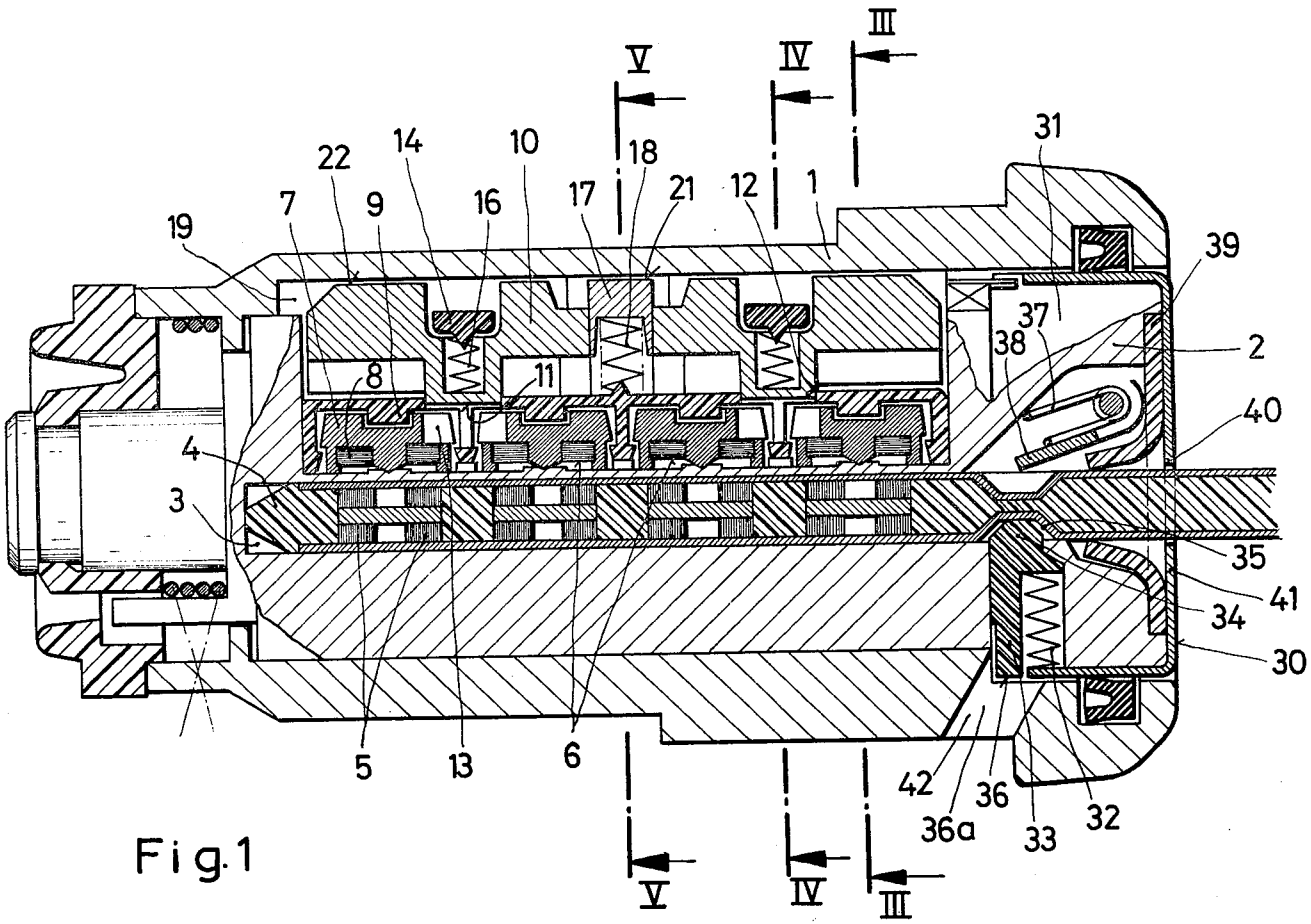
FIG. 1 is a section through a magnetic lock according to the invention with the key inserted.

DETAILED DESCRIPTION OF PREFERRED EXAMPLE EMBODIMENTS AND OF THE BEST MODE OF THE INVENTION

A locking cylinder 2 having a locking channel 3 extending along a precisely determined length for a key 4, is supported in a housing 1 of a magnetic lock according to the invention, whereby the locking cylinder 2 is rotatable and locked against axial displacement.

The key 4 is made of a non-magnetizeable material such as brass and comprises inside it permanent magnets or control magnets 5 having a coded shape and cooperating with magnetic rotors 6 arranged in the locking cylinder 2. Each magnetic rotor 6 comprises on its part the rotor 7 proper, which is rotatably supported in the locking cylinder 2 and one or several magnets 8. All magnetic rotors 6 are centered in a cage 9 and secured against loss.

The form and shape of the cage 9 is best seen in FIG. 1.

A locking bar 10 is arranged above the cage 9. The locking bar 10 comprises sensing surfaces 11 or projections 11 by means of which the locking bar 10 may reach through holes 12 in the cage 9. The rotors 7 comprise recesses 13 into which the projections 11 of the locking bar 10 may reach as soon as the magnetic rotors 6 are respectively aligned when a fitting key 4 is used.

The locking bar 10 is held by means of U-shaped clamps 14 (FIG. 1 and FIG. 4) which comprise on their legs hook-shaped projections 15 which reach behind shoulders on the locking cylinder 2. The clamps 14 may be snapped onto the locking cylinder 2.

In the illustrated example embodiment, two clamps 14 reach around the locking bar 10. Springs 16 are arranged between the bridging portion of the clamps 14 and the locking bar 10. The springs 16 urge the locking bar 10 toward the magnetic rotors 7.

A control member 17 is inserted in a recess of the locking bar 10. The control member 17 is pressed radially outwardly into the locking channel 18. For this purpose the spring 18 rests itself on the one hand against the control member 17 and on the other hand against the cage 9.

The control member 17 has a U-shaped cross section (FIG. 5) and comprises at its legs projections 20 functioning as entraining members reaching behind respective shoulders on the locking bar 10.

Figure 5:
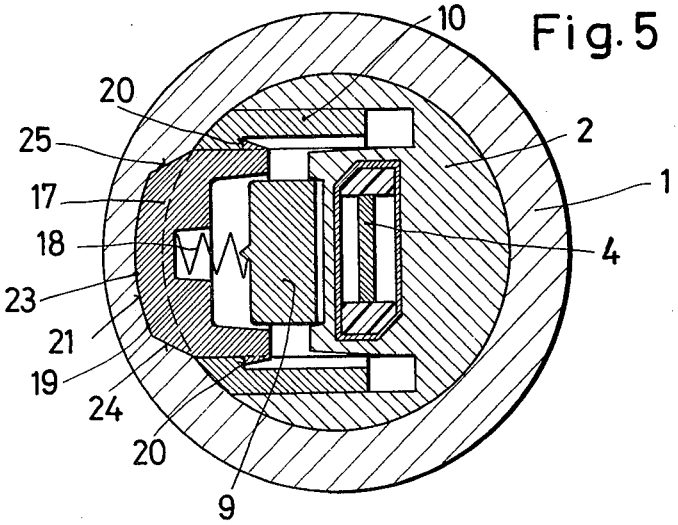
FIG. 5 is a sectional view along section line V—V in FIG. 1.

When the control member 17 according to FIG. 5 is displaced radially outwardly so that it rests with its edge 21 in the locking channel 19, the locking bar 10 also reaches into the locking channel 19 with its edge 22 facing away from the projections 11. The projections 20 on the control member 17 thus pull the locking bar 10 into the locking position in response to a radially outwardly directed movement. However, if the control member 17 moves radially inwardly, a corresponding movement of the locking bar 10 does not necessarily follow because the projections 20 may disengage themselves from the respective shoulders on the locking bar 10. The control member 17 is thus displaceable radially inwardly also without the locking bar 10.

The projections 20 are arranged on the outside of the legs of the U-shaped control member 17. The corresponding shoulders on the locking bar 10 are respectively located on the inside. Further, the U-shaped control member 17 reaches around the cage 9 when the member 17 moves radially inwardly as is clearly evident from FIG. 5. FIG. 5 further shows how the locking bar 10 is supported in the locking cylinder 2 or rather how it is guided for the radially directed movement.

Figure 6:
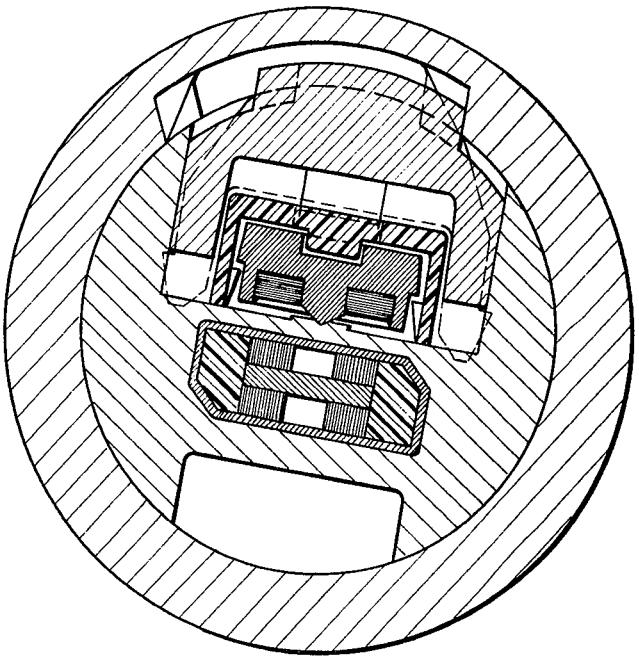
FIG. 6 is a section as in FIG. 3 through a mangnetic lock illustrating a closing attempt by means of a non-fitting key.

The edge 21 of the control member 17 reaching into the locking channel 19 is bounded by a circular arc piece 23 and two slanted surfaces 24, 25. There, the base surface of the locking channel 19 has a corresponding circular arc-shape and the side walls of the locking channel 19 extend at a slant relative to each other in correspondence with the slanted surfaces 24, 25 of the control member 17. If the locking cylinder 2 is being rotated, the slanted surfaces 24, 25 operate as wedging surfaces and press the control member 17 out of the locking channel 19 into the locking cylinder 2. This situation is shown in FIG. 6.

Figure 3:
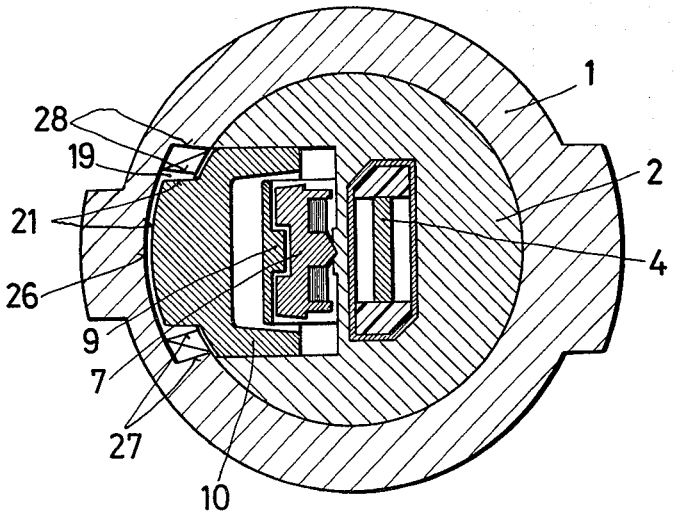
FIG. 3 is a sectional view along the section line III—III in FIG. 1.
Figure 4:
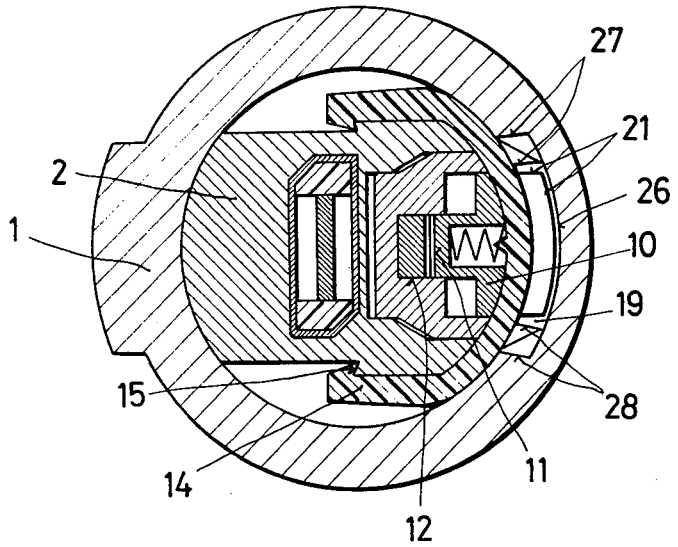
FIG. 4 is a sectional view along section line IV—IV in FIG. 1.

Directly next to the control member 17 the base surface 26 of the locking channel 19 is also of circular bow-shape as shown in FIGS. 3 and 4. The lateral bounding surfaces 27 and 28 of the locking channel 19 extend in parallel and substantially radially to the rotational axis of the locking cylinder, so that the locking bar 10 which rests with its edge 22 against the lateral bounding surfaces is not displaced radially inwardly into the locking cylinder 2 by any wedging effect. Thus, whereas the base surface 26 of the locking channel 19 has a circular arc-shape along its entire length, the lateral bounding surfaces are differently inclined depending on whether the locking channel is involved in the zone of the control member 17 and its edge 21 extending out of the locking cylinder or whether the zone of the locking channel 19 is involved into which the edge 22 of the locking bar 10 reaches.

Figure 2:
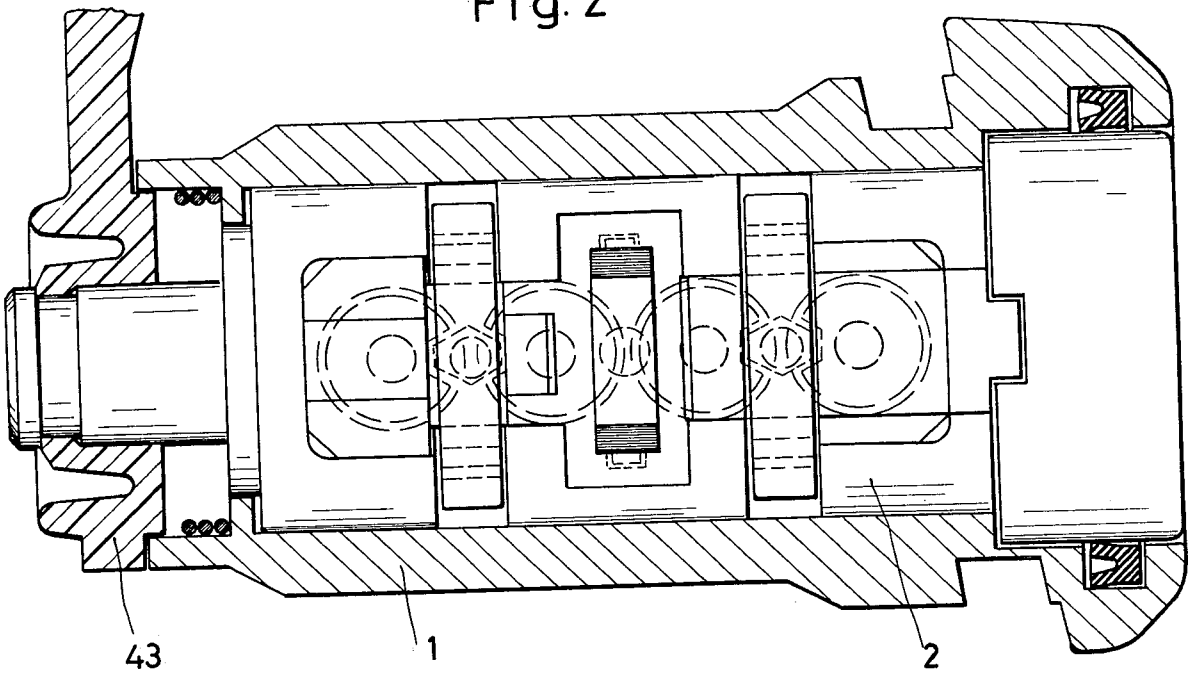
FIG. 2 is a view showing the locking cylinder in a sectional view of the lock housing.

FIGS. 2 and 3 thus each show two bounding surfaces 27, and two bounding surfaces 28. This is due to the fact, that the locking channel 19 in FIG. 1 is broader to the right of the control member 17 as shown in FIG. 1 than to the left of the control member 17.

A cross slide 33 is arranged in the head 31 of the locking cylinder 2 near the key insertion side of the facing surface 30 of the magnetic lock. The cross slide 33 is biased by a pressure spring 32. The cross slide 33 reaches all the way into the key channel 3 with one of its wedge shaped ends 34, where it rests, when the key 4 is inserted, in a depression or recess 35 of the key 4.

The free end 34 of the cross slide 33 and the recess 35 in the key 4 respectively comprise two slanted surfaces and a further surface between the slanted surfaces, said further surface extending in parallel to the axis of the key. When the key 4 is being inserted, its beveled free end contacts the slanted surface at the free end 34 of the cross slide thereby pressing the cross slide radially outwardly. When the key is withdrawn, the slanted surface shown on the left side in FIG. 1 presses the cross slide 33 outwardly.

The second free end 36 of the cross slide 33 enters into an opening **36*a* in the lock housing 1 when the cross slide 33** is shifted radially outwardly.

A flap 38 biased by a torque spring 37 is arranged in the head 31 of the locking cylinder 2. The flap 38 serves together with a disk 39 of rubber or synthetic material for sealing the key entrance opening 40. A cap 41 covers the locking cylinder head 31.

The cross slide 33 acting as a stop, performs several functions. It serves for centering of the locking cylinder 2 and thus of the locking bar 10 as well as of the control member 17 in their null position. Such centering makes sure that the locking bar 10 upon insertion of the key 4 does not exert any pressure on the magnetic rotors 6, which otherwise might hinder their alignment.

The cross slide 33 further prevents that the key 4 may be withdrawn when the locking cylinder 2 is not in the null position. This is so because the end 36 of the cross slide 33 is then not located in front of the opening **36*a* into which the end 36 must yield so that the wedge-shaped end 34 of the cross slide 33 may pass out of the recess 35 in the key 4**.

Finally, the cross slide 33 prevents that the locking cylinder 2 may be rotated when, for example, in connection with a forceful entry a key or object without the recess 35 is inserted into the key channel 3. In such an instance, the cross slide 33 is completely shifted radially outwardly out of the key channel 3 and rests with its outer end 36 against the lateral bounding surfaces 32 (in parallel to the plain of the sheet of the drawing in FIG. 1) of the opening **36*a*. Thus, rotation of the locking cylinder 2** is impossible.

The function and operation of the magnetical lock according to the invention is as follows.

Upon insertion of a fitting key 4 first the cross slide 33 serving as a stop is shifted radially outwardly against the pressure of the spring 32. This results in a precise centering of the null position of the locking cylinder 2 if it should not have been in this position. Upon completion of the insertion of the key 4 all the way to the stop in the key channel 3 the magnetic rotors 6 have aligned themselves in such a manner that the sensing surfaces or projections 11 of the locking bar 10 may enter into the recesses 13 of the magnetic rotors 6. Simultaneously, the cross slide 33 has been pressed by the spring 32 again into the position shown in FIG. 1 because the key 4 is provided with the recess 35 at the correct location.

Upon rotating the locking cylinder 2 by means of the key 4, the control member 17 is pressed out of the locking channel 19 by the slanted surfaces 24 or 25 depending upon the direction of rotation. The projections 20 on the control member 17 release the locking bar 10 so that the latter is displaced radially inwardly into the locking cylinder 2 by the springs 16 whereby the edge 22 of the locking bar 10 moves out of the locking channel 19 and the projections 11 enter into the recesses 13 in the magnetic rotors 6. The locking cylinder 2 and an entraining member 43 arranged on the locking cylinder 2 are now freely rotatable as shown in FIG. 2.

If an attempt is being made to lock by means of a wrong key the following situations may occur.

If the wrong key does not have any recess 35 at all or if it has a recess 35 in the wrong position, the locking cylinder 2 is prevented from rotation by the cross slide 33.

If the wrong key has a recess 35 in the correct location, however, if it comprises a wrong coding of the control magnets 5 the cross slide 33 will release the locking cylinder 2 for rotation. However, the magnetic rotors 6 do not adjust themselves, so that the projections 11 on the locking bar 10 could enter into the recesses 13. Rather, the projections 11 rest directly in front of the facing surfaces of the magnetic rotors 6 so that the locking bar 10 cannot be displaced.

Although the invention has been described with reference to specific example embodiments, it will be appreciated, that it is intended, to cover all modifications and equivalents within the scope of the appended claims.

Besides, the locking cylinder 2 is rotatable only to a small extent namely, until the edge 22 of the locking bar 10 in the locking channel 19 contracts the lateral bounding surfaces 27 or 28 of the locking channel 19. In connection with this small rotational movement, the control member 17 may be already displaced somewhat out of the locking channel 19 by the slanted surfaces 24, 25 because some play must always be present between the edge 22 of the locking bar 10 and the bounding surfaces 27, 28 of the locking channel 19.

When a wrong key is used, the magnetic rotors 6 are not subjected to larger loads even if increasing force is applied. Rather, the rotors 6 are relieved because the springs 16 relax when the locking bar 10 is removed out of the locking channel 19 whereby the pressure force of the springs becomes smaller. However, the pressure force of the spring 18 biasing the control member 17 increases in response to an increasing excursion of the control member 17. However, this increasing pressure or force does not have any influence on the loading of the magnetic rotors 6.

However, an absolutely necessary requirement for the function of the magnetic lock according to the invention is the condition that the force of the spring 18 must be larger than the sum of the forces of the springs 16 in the loaded condition.

We claim:

1. A magnetic locking mechanism, comprising key means including a plurality of control magnets, and locking means including lock housing means (1), locking cylinder means (2) rotatably supported in said lock housing means, locking bar means (10) having a locking channel (19) therein, said locking bar means being operatively supported for radial displacement in said locking housing means, magnetic rotor means (6) operatively supported in said lock housing means for locking and releasing said locking bar means, control means (17), spring means (18) operatively biasing said control means (17) which are supported in said housing means for displacement into said locking channel (19) of the locking bar means (10), said control means (17) comprising entrainment means (20) operatively engaging said locking bar means (10), and further spring means (16) operatively biasing said locking bar means (10) toward said magnetic rotor means (6).

2. The magnetic locking mechanism of claim 1, further comprising clamping means (14) operatively engaging said locking bar means (10), said further spring means (16) being operatively arranged between said clamping means (14) and said locking bar means (10).

3. The magnetic locking mechanism of claim 1, wherein said first mentioned spring means (18) bias said control means (17) radially outwardly in said lock housing means (1), said first mentioned spring means (18) having a spring force which is larger than the spring force of said further spring means (16) pressing said locking bar means (10) toward the magnetic rotor means (6).

* * * * *